US005431320A

United States Patent [19]

Hash

[11] Patent Number: 5,431,320

[45] Date of Patent: Jul. 11, 1995

[54] SUSPENSION STRAP FOR MUSICAL INSTRUMENT

[76] Inventor: Michael J. Hash, 15565 Maplewood Dr., Sonoma, Calif. 95476

[21] Appl. No.: 192,253

[22] Filed: Jan. 24, 1994

[51] Int. Cl.[6] ..... A45F 3/14

[52] U.S. Cl. ..... 224/258; 224/910; 84/327; D3/215; D17/20

[58] Field of Search ..... 224/257, 258, 264, 910; 84/327; 24/573.7; 450/141; 2/323; D3/204, 327, 222, 215; D17/20; 150/108

[56] References Cited

U.S. PATENT DOCUMENTS

| | | | |
|---|---|---|---|
| 2,082,346 | 6/1937 | Lavenson | 2/312 |
| 2,643,039 | 6/1953 | Sottile | 224/250 |
| 3,237,502 | 3/1966 | Moseley | 84/327 |
| 3,323,698 | 6/1967 | Sottile | 224/264 |
| 3,688,012 | 8/1972 | Vettel | 84/327 |
| 4,148,423 | 4/1979 | Schlader | 224/258 |
| 4,291,822 | 9/1981 | Simonds | 84/327 |
| 4,785,705 | 11/1988 | Patterson | 84/327 |

FOREIGN PATENT DOCUMENTS

| | | | |
|---|---|---|---|
| 333075 | 8/1930 | United Kingdom | 150/108 |

*Primary Examiner*—Linda J. Sholl

[57] ABSTRACT

A suspension strap for placing over the shoulder down and across the back of a person, to suspend a musical instrument of the guitar family in front of said person, said strap comprising relatively flat, flexible, non-elastic material of sufficient tensile strength to suspend a musical instrument of the aforementioned type, said strap further comprising lateral curvature of intersecting radius' intermediate the ends and means whereby each end adjusts independently, said strap further comprising means whereby straps of the same make and color are easily distinguishably different.

5 Claims, 1 Drawing Sheet

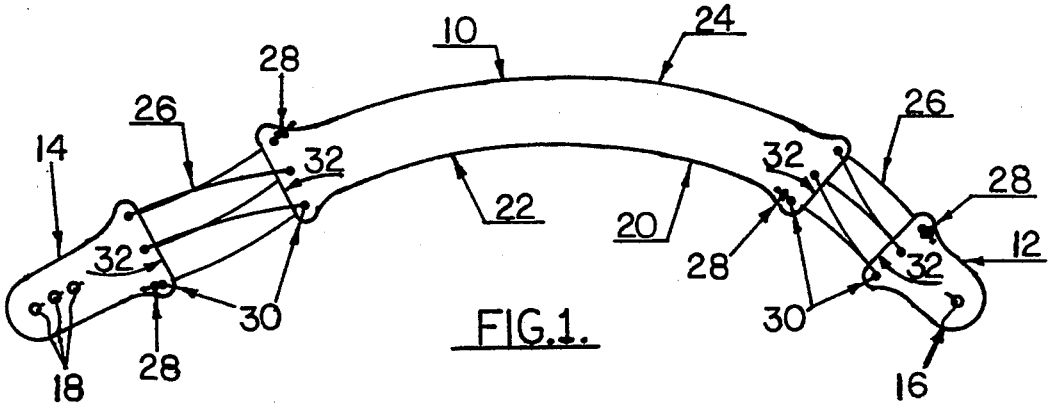
FIG.1.
FIG. 2.
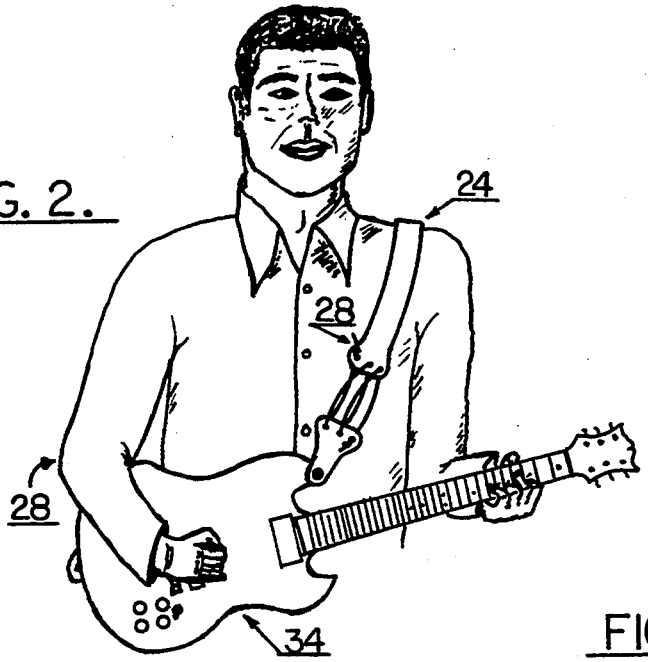
FIG. 3.
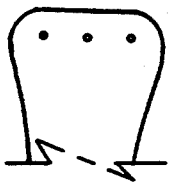
FIG. 4.
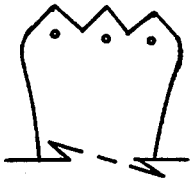
FIG. 5.
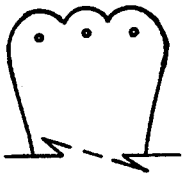
FIG. 6.
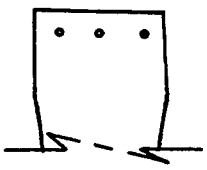
FIG. 7.
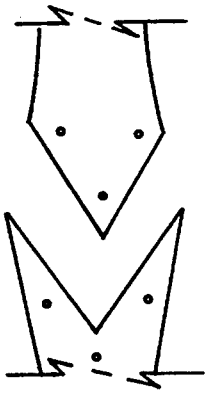

SUSPENSION STRAP FOR MUSICAL INSTRUMENT

This invention relates to straps for suspending a musical instrument of the guitar family in front of a person. More specifically, an improved strap for close proximity attaching of a Guitar, Electric Bass Guitar, or synthesizer of the Guitar family in front of a person in a manner that the individual person prefers.

DISCUSSION OF PRIOR ART

Prior art straps that are formed with lateral curvature to or through the longitude dictate a location in the longitude that must be kept very near the top of the shoulder, therefore if a strap with curvature of this nature does not provide a means whereby the strap is fully adjustable at both ends, then the strap dictates a position in which the musical instrument is going to be played. It should be understood that comfort cannot be dictated, it must be provided. Some musicians find comfort with the instrument high on their body, some prefer it low, some like the fingerboard at an incline, while others prefer it level, high with an incline, etc. Accordingly it should be noted that straps with too large a radius ride on their edge like a straight strap, and that straps with too small a radius ride on the opposite edge, therefore the size of the radius is a key factor.

It should also be noted that straps with a straight end section of the posterior portion and a small radius over the shoulder produce a situation whereas this straight end section exits the back over the shoulder blade on the opposite side of the body than that which supports the strap when said strap is in its shorter positions on some musicians; this is uncomfortable and distracting. It should also be noted that the higher quality straps are made of heavy gauge leather which is semi rigid in the manner in which they are used, enough so as to support its own weight and thereby if a musician lifts the instrument, the strap, through means of its own rigidity, lifts off the shoulder and can change positions. Also prior art straps have always been made in a manner whereas straps of the same make and color could not be easily distinguishable, so if the musicians of a group put their straps of the same make and color together, then the musicians would have difficulty telling the straps apart, as bands travel on band buses in close quarters, or the equipment is transported and set up by others, this becomes a frequent problem.

OBJECTS

It is the object of this invention to provide a suspension strap for musical instruments of the Guitar family that overcomes the aforementioned difficulties. Other objects will become apparent in the forthcoming descriptions.

The objects of this invention are achieved by providing suspension straps comprised of an anterior piece and a posterior piece each with a hole and slit near the outermost end for attaching to the strap attaching pegs on the body of a conventional guitar-type instrument. These pieces are loosely laced, each at its respective end to their respective end of a main body piece which is made with intersecting radius' one from each end converging nearer the anterior portion of said main body piece giving proper lateral curvature through the longitude. It should be noted that the posterior portion of a strap crosses the entire back, while the anterior portion of a strap crosses back over only approximately half of the front of a person for this close proximity attaching.

It is found that two different size radial arcs, of different duration, each drawn from a different axis point is best. Also, as the lacing provides a means of adjustment at each end, they also have an aesthetic value in that changing the color of the laces changes and enhances the appearance of the strap, for heavy duty applications, use doubled lacing at each end, also on doubled lacing applications, one can use two different colors at the same end, etc. This invention further comprising a series of different shaped lacing end designs, thereby providing straps of the same make and color that are easily distinguishably different. Also, there are no metal or plastic parts to scratch or chip the finish on an expensive instrument, or catch on clothing.

DRAWINGS

FIG. 1 is a plan view of the invention.

FIG. 2 is an elevation view illustrating the invention in use.

FIG. 3 through FIG. 7 are plan views of some different lacing end designs.

DESCRIPTION

While the preferred material for constructing the strap is leather, it may be constructed of any relatively flat flexible non-elastic material having sufficient tensile strength to suspend a heavy musical instrument that is to be supported by a person's shoulder for playing.

OPERATION

Referring in detail to the drawings, FIG. 1 is a plan view using the reference numeral 10 to represent the main body piece of the strap. This main body piece is curved laterally through the longitude, said curvature being of intersecting radius' one from each end as at 20 for in front of the person and as at 22 for in back of the person, with the convergence at 24 for the top of the shoulder, radius 20 being smaller than radius 22 and radius 20 being of a shorter duration than radius 22 and each radius being drawn from a different axis point, these radius' being between about 20 inches and 38 inches and preferably between about 22 inches and 34 inches. Said main body piece terminates with its opposite ends about 45 degrees apart though they can be between about 35 degrees and 55 degrees. To the anterior portion of the main body piece 10 is secured the anterior piece 12 with its hole and slit 16 for attaching to the musical instrument 34, this securing is provided by lacing 26 through a series of small holes 30 near the respective end of each piece, said lacing having a knot tied at each end as at 28, this lacing impedes the rigidity of the strap and provides a somewhat rotational pendulum-like means of adjustment, the same is true of the posterior portion of the main body piece 10 where the posterior piece 14 with its hole and slit 18 for attaching to the musical instrument 34 is secured.

I have not referred in detail to holes and slits 16 and 18 as they are well known in prior art. FIG. 2 is an elevation view illustrating the strap as normally used where the radius convergence 24 is at the top of the shoulder, radius 20 is in front of the person and radius 22 is in back. FIG. 2 also illustrates how readily available knots 28 are for a simple one hand adjustment of either end with musical instrument 34 in place. FIG. 3 through FIG. 7 are plan views of some different shaped lacing end designs that, when applied to the respective end or ends of piece 10, 12, and 14 shown in FIG. 1, as 32 provide easily distinguishably different straps of the same make and color. While the above description contains many specifics, these should not be construed as limitations on the scope of the invention but rather as an exemplification of one preferred embodiment thereof, other variations are possible. For example, other than different shape lacing end designs, holes near the ends of the main body piece can be used to identify easily different straps such as square, round, triangle, rectangle, diamond, double diamond, double square, five point star, four point star, diamond and star, etc.

I claim:

1. A suspension strap for placing over a shoulder and across a back of a person to suspend a musical instrument of a guitar family in front of said person, comprising:

a relatively flat, flexible, non-elastic elongated material forming a continuously curved main body having a top surface, a bottom surface, a first end, a second end, a first side, and a second side;

a posterior piece having a first end and a second end; the first end of the posterior piece having means for attaching the strap to the instrument; the second end of the posterior piece being connected at a distance to the first end of the main body by means for adjusting the distance between the posterior piece and the main body;

an anterior piece having a first end and a second end; the first end of the anterior piece having means for attaching the strap to the instrument; the second end of the anterior piece being connected at a distance to the second end of the main body by means for adjusting the distance between the anterior piece and the main body;

said main body having a laterally curved posterior portion formed by a posterior radius and a laterally curved anterior portion formed by a anterior radius; the posterior radius and the anterior radius being different lengths; said posterior portion extending from the first end of the main body and said anterior portion extending from the second end of the main body and meeting to form the continuously curved main body; and the posterior radius and the anterior radius extending from the first side of said main body in the same general direction.

2. The suspension strap of claim 1 wherein said posterior radius is between about 28 inches and 38 inches.

3. The suspension strap of claim 2 wherein said anterior radius is between about 20 inches and 35 inches.

4. The suspension strap of claim 3 wherein said means for adjusting the distance between the posterior piece and the main body and said means for adjusting the distance between the anterior piece and the main body operate independently.

5. The suspension strap of claim 1 wherein at least one of the first and second ends of the main body and the second ends of the posterior piece and anterior piece having a series of different edge designs for easily distinguishing different straps of the same configuration and color.

* * * * *